US011732452B2

(12) United States Patent
Hausmann et al.

(10) Patent No.: US 11,732,452 B2
(45) Date of Patent: Aug. 22, 2023

(54) IN-WALL CISTERN AND DRINKING WATER PIPE SYSTEM

(71) Applicant: Viega Technology GmbH & Co. KG, Attendorn (DE)

(72) Inventors: Jennifer Hausmann, Schmallenberg (DE); Patrick Dietermann, Lennestadt (DE); Patrick Steger, Kreuztal (DE); Andre Ruhrmann, Finnentrop (DE); Marko Vojkovic, Herscheid (DE); Julian Ziegeweidt, Drolshagen (DE)

(73) Assignee: Viega Technology GmbH & Co. KG, Attendorn (DE)

( * ) Notice: Subject to any disclaimer, the term of this patent is extended or adjusted under 35 U.S.C. 154(b) by 38 days.

(21) Appl. No.: 17/436,264

(22) PCT Filed: Feb. 25, 2020

(86) PCT No.: PCT/EP2020/054812
§ 371 (c)(1),
(2) Date: Sep. 3, 2021

(87) PCT Pub. No.: WO2020/178062
PCT Pub. Date: Sep. 10, 2020

(65) Prior Publication Data

US 2022/0162840 A1 May 26, 2022

(30) Foreign Application Priority Data

Mar. 6, 2019 (DE) ..... 10 2019 105 614.4

(51) Int. Cl.
*E03D 1/00* (2006.01)
*E03D 1/34* (2006.01)
*E03D 5/10* (2006.01)

(52) U.S. Cl.
CPC ..... *E03D 1/003* (2013.01); *E03D 1/34* (2013.01); *E03D 5/10* (2013.01)

(58) Field of Classification Search
CPC .. E03D 5/10; E03D 1/34; E03D 1/003; E03D 1/32; B08B 9/02; E03B 7/08
See application file for complete search history.

(56) References Cited

U.S. PATENT DOCUMENTS 10,711,439 B2 7/2020 Arens et al.
2018/0135285 A1 5/2018 Canfield et al.

FOREIGN PATENT DOCUMENTS

CN 101289874 A 10/2008
CN 102635147 A 8/2012
(Continued)

*Primary Examiner* — Erin Deery
(74) *Attorney, Agent, or Firm* — The Webb Law Firm

(57) ABSTRACT

The invention relates to a cistern, in particular an in-wall cistern, for a toilet or urinal, with a drain valve which has a closure body which can be lifted from a closed position into a flushing position. The closure body is designed as an overflow pipe and has a seal which rests tightly on a valve seat in the closed position, with at least one water intake line, with a valve assembly for letting in drinking water present in the water intake line, with a water discharge line for discharging the drinking water let in by the valve assembly, and with a controller which generates a control signal for actuating the valve assembly as a function of a sensor signal and/or when a predefined time interval has been exceeded.

15 Claims, 4 Drawing Sheets

(56) References Cited

FOREIGN PATENT DOCUMENTS

| | | | | | |
|---|---|---|---|---|---|
| CN | 105492809 | A | | 4/2016 | |
| DE | 10222193 | A1 | * | 11/2003 | ..... E03D 1/142 |
| DE | 202011105696 | U1 | | 3/2012 | |
| DE | 102016118770 | A1 | | 4/2018 | |
| DE | 202017100660 | U1 | | 5/2018 | |
| EP | 2166159 | B1 | | 12/2015 | |
| WO | 2018145878 | A1 | | 8/2018 | |

* cited by examiner

IN-WALL CISTERN AND DRINKING WATER PIPE SYSTEM

CROSS-REFERENCE TO RELATED APPLICATIONS

This application is the United States national phase of International Application No. PCT/EP2020/054812 filed Feb. 25, 2020, and claims priority to German Patent Application No. 10 2019 105 614.4 filed Mar. 6, 2019, the disclosures of which are hereby incorporated by reference in their entirety.

BACKGROUND OF THE INVENTION

Field of the Invention

The invention relates to a cistern, in particular an in-wall cistern, for a toilet or urinal, with a drain valve which has a closure body which can be lifted from a closed position into a flushing position, wherein the closure body is designed as an overflow pipe and has a seal which rests tightly on a valve seat in the closed position, with at least one water intake line, with a valve assembly for letting in drinking water present in the water intake line, with a water discharge line for discharging the drinking water let in by the valve assembly, wherein the valve assembly lets in the drinking water before into the water discharge line, and with a controller and a sensor assigned to the controller, wherein the controller generates a control signal for actuating the valve assembly as a function of a sensor signal, the sensor signal being proportional to a measured water temperature in the water intake line, and/or when a predefined time interval has been exceeded since the last withdrawal of drinking water from the water intake line, wherein the valve assembly lets in water from the water intake line as a function of the control signal.

Description of Related Art

Furthermore, the invention relates to a drinking water pipe system with at least one cold water line and/or at least one hot water line, with a sensor for measuring the water temperature in the cold water or hot water line and/or for detecting a withdrawal of drinking water from the cold water or hot water line, wherein the sensor generates a sensor signal proportional to the measured water temperature and/or to a detected withdrawal of drinking water and wherein, when the sensor is suited for detecting a withdrawal of drinking water from the cold water or hot water line the drinking water pipe system comprises a time-measuring device and the sensor activates the time-measuring device in the case of a detected withdrawal of drinking water, and with a cistern of the type mentioned above.

Drinking water installations are subject to strict hygiene requirements in order to rule out direct or indirect health impairments and disruption to the well-being of the individual user. The aim is to ensure faultless drinking water quality in the respective drinking water installation. In drinking water installations, microorganisms, including pathogens such as legionella, can multiply. Legionella can multiply to hygienically relevant concentrations in installations with heated drinking water, where water temperatures are between 25° C. and 50° C. In particular due to stagnation and unsuitable operation, the drinking water quality in the pipelines and apparatus of a drinking water installation can be impaired by the proliferation of microorganisms or by an increased concentration of dissolving proportions of the materials of the apparatus or pipelines such that the requirements placed on drinking water are no longer met.

A known measure for maintaining a hygienically flawless drinking water quality is to provide a drinking water circulation line, which supplies heated drinking water without a withdrawal point to a drinking water heater, e.g. a storage drinking water heater in which the drinking water reaches a minimum temperature of e.g. approx. 60° C.

Another known measure for maintaining a hygienically flawless drinking water quality is to arrange a flushing station at the end of a train of water pipes, for example at one end of a drinking water floor line of a residential building or hospital. The flushing station enables a targeted draining of cold and/or hot water into a drain in order to enable a replacement of the water in the respective train of water pipes.

A drinking water pipe system is known from EP 2 166 159 B1, in which a cold water line is designed as a series line. The cold water line has at least one draw valve serving as a withdrawal point and one outflow, wherein a toilet cistern is connected to the outflow, and wherein the cistern is arranged at the end of the cold water line. In order to maintain drinking water hygiene and to avoid unnecessarily high water consumption, the drinking water line system is provided with an electronic controller, which is provided with a time-measuring device and detects a withdrawal of drinking water from the cold water line via a sensor, wherein the sensor activates the time-measuring device in the case of a withdrawal of drinking water and the electronic controller actuates an actuating device of the cistern to trigger a toilet flush if a predefined time interval has been exceeded since the last withdrawal of drinking water. Using this system, an equal amount of cold water is always withdrawn from the cold water line at the same maximum intervals in order to flush the same.

Furthermore, a cistern of the type mentioned at the outset is known from WO 2018/145878 A1. The cistern comprises a flushing device with a cold water intake line, a hot water intake line, a valve assembly for letting in the water flowing in through the cold water intake line and the hot water intake line and a water discharge line for discharging the water let in by the valve assembly. In addition, the flushing device has at least one temperature sensor for measuring the water temperature in the cold water intake line and/or the hot water intake line and for generating at least one temperature signal. Furthermore, a controller is provided to actuate the valve assembly. The controller generates a control signal as a function of the temperature signal, wherein the valve assembly drains water through the water discharge line into the cistern as a function of the control signal. As is common in the prior art, the cistern is provided with a cistern valve assembly by means of which at least part of the water quantity contained in the cistern can be drained to flush a toilet. The cistern is also provided with an overflow as common in the prior art, which serves to drain water from the cistern which rises above a predefined water level in the cistern without actuating the cistern valve assembly. The overflow is thereby defined by a valve closure body of the cistern valve assembly designed as an overflow pipe. Although this cistern also enables a hygienic flushing of a hot water line in addition to a hygienic flushing of a cold water line, the respective hygienic flushing does not take place regardless of the flushing water level. In the case of a hygienic flush, the safety distance of the overflow water level prescribed in DIN EN 14055 from the marking for the highest nominal water level to be provided by the cistern manufacturer is remained under.

DE 102 22 193 A1 describes a cistern for a toilet bowl with an electronically controlled water flushing, which is supposed to make it possible through an interaction of program-controlled sequence control with electrical actuators and sensors to dispose feces through a toilet bowl and finally into the wastewater, and this with minimal use of material, energy and water. The fresh water supply to the cistern is controlled by two solenoid valves. To fill the cistern, one of the two solenoid valves is opened, with water flowing through a pipe into the lower area of the cistern. The other solenoid valve is used to perform a small pressure flushing. For this purpose, a hose is connected to the valve which opens into the overflow pipe serving as a drain valve body. Pressure flushing is triggered by pressing a push button. DE 102 22 193 A1 does not deal with a device for hygienic flushing of a drinking water pipe.

SUMMARY OF THE INVENTION

Based on this, the object underlying the invention is to provide a cistern of the type mentioned at the outset, which makes it easier to keep the drinking water hygienic, avoids unnecessarily high water consumption and enables hygienic flushing regardless of the flushing water level.

The object is achieved according to the invention in the case of a cistern of the type mentioned at the outset in that the water discharge line is designed in such manner that it drains the drinking water let in by the valve assembly directly into the overflow pipe.

This provides a cistern that makes it easier to maintain the drinking water hygienic, which offers the possibility of carrying out required hygienic flushes with relatively low water consumption, and which enables hygienic flushing regardless of the flush water level. Overfilling of the cistern is reliably prevented by direct discharge of the drinking water let in by the valve assembly into the overflow pipe for the purposes of a hygienic flush. The direct discharge of the drinking water that has been let in for a hygienic flush into the overflow pipe also offers the advantage that the hygienic flush is quiet. A conventional hygienic flush, in which the closure body of the cistern drain valve is lifted from the closed position to a flush position, is, on the other hand, noisy and relatively loud due to the resulting surge-like flush.

The dependent claims show expedient and advantageous embodiments of the subject matter of the invention.

Preferably, the at least one water intake line of the cistern according to the invention is designed in two or more parts, wherein one of the water intake lines is provided as a cold water intake line and another of the water intake lines is provided as a hot water intake line. The cistern is thus designed both for a hygienic flushing of a cold water line according to need and for a hygienic flushing of a hot water line according to need. The hot water intake line can also be referred to as a warm water intake line.

A further advantageous embodiment of the invention is characterised in that the valve assembly is designed as a mixing unit for mixing, preferably variably mixing drinking water let in from the cold water intake line and from the hot water intake line. The design of the valve assembly as a mixing unit enables a compact design of the water discharge line connected to the valve assembly. The water discharge line then occupies little space, which is favourable in terms of the arrangement of the water discharge line in the usually limited installation space above the overflow pipe.

The controller or mixing unit of the cistern according to the invention is preferably designed in such manner that the cold water intake line and the hot water intake line are not always flushed at the same time during a hygienic flush. Rather, the controller or the mixing unit of the cistern according to the invention is preferably designed in such manner that each of these two intake lines is flushed according to need.

It is also advantageous if the valve assembly according to a further embodiment of the invention is provided with an electromechanical drive, which is coupled to at least one movable valve body, preferably in the form of a movable perforated disc. This allows a compact, space-saving valve assembly, in particular a mixing unit, to be realised. The valve assembly is preferably designed in the manner of a valve cartridge of a single-lever mixer tap. The movable valve body is preferably controllable by the control signal generated by the controller and/or by an assigned control signal generated by the controller. The movable valve body is for example designed as a rotatable valve body, preferably as a rotatable perforated disc. As a result, a very fine, preferably continuous adjustability of the valve body relative to a fixed valve body part can be realised.

According to a further embodiment of the invention, an outlet of the valve assembly or the water discharge line is provided with a sensor for measuring the water temperature and for generating a temperature signal, wherein this sensor is the sensor assigned to the controller, and wherein the controller controls the valve assembly as a function of the temperature signal. This configuration of the invention comprises in particular an embodiment in which the cistern is provided with a cold water intake line and a hot water intake line and the valve assembly is designed as a mixing unit for automatically variably mixing drinking water let in from the cold water intake line and from the hot water intake line. This embodiment has the advantage that a thermal load on the cistern during a hygienic flush of the hot water intake line is avoided by adding cold water from the cold water intake line to hot water from the hot water intake line.

In order to ensure a reliable orientation of the water discharge line with respect to the overflow pipe of the drain valve during operation of the cistern, the water discharge line preferably has an outlet piece which is connected to the drain valve, preferably detachably connected. For example, the outlet piece of the water discharge line is detachably connected to a fixed or fixable housing part or positioning part of the drain valve.

An advantageous configuration of the invention with respect to the mounting of the outlet piece is characterised in that the outlet piece is provided with a fastening means, which is positively connected, preferably detachably locked, to a positioning frame connected to the drain valve. This configuration enables a quick, simple and stable connection of the outlet piece to the drain valve. This configuration also enables easy disassembly of the outlet piece or drain valve, for example for maintenance purposes.

Preferably, the valve assembly and the controller are arranged in a common housing. In this case the controller is essentially designed as an electronic controller. Therefore, the combination of controller, valve assembly and common housing can also be referred to as an electronic mixing unit. This configuration enables cost-effective prefabrication of various components of the cistern as well as fast mounting of valve assembly and controller on the cistern body of the cistern.

A further advantageous configuration of the invention is characterised in that the valve assembly and the controller are mounted on a common support frame. This further optimises cost-effective prefabrication as well as fast mounting of valve assembly and controller on the cistern body of the cistern. Preferably, the support frame is designed for mounting at an inspection opening of the cistern.

According to a further configuration of the invention, the valve assembly and the controller are arranged below or behind a hood-shaped cover. As a result, the controller and the valve assembly can be protected not only against mechanical effects. The cover also offers the option of attaching a further connection for a water intake line if the appropriate dimensioning is used. Thus, for the manufacture of a cistern according to the invention, if this should preferably have, in addition to a cold water intake line, also a hot water intake line, a conventional cistern body can advantageously be used, which has an inspection opening on its front side and its upper side in each case and is provided with only one single connection for a water intake line. In particular, the invention comprises a configuration in which the cover is provided with a connection for a water intake line, preferably a cold water intake line, wherein a water line pointing into the cistern and having a branch is connected to this connection. On the one hand, a float-operated filling valve and, on the other hand, a cold water intake line leading to the valve assembly of the mixing unit can be connected to this water line and to its branch.

A further advantageous configuration of the invention is characterised in that the controller is provided with a network connection for linking to a further or superordinate controller. The controller or mixing unit can therefore be linked and can (also) be actuated by a superordinate controller. In this case peripheral devices and/or sensors such as e.g. peripheral temperature sensors provide signals to the controller of the cistern for triggering a hygienic flush. In addition to the mixing unit or the controller of the cistern, the superordinate controller can for example also control a flushing station, a circulation valve, a wall outlet fitting, a bathtub inlet fitting and/or a shower inlet fitting.

However, the controller or mixing unit of the cistern according to the invention can also be designed as an independent or so-called stand-alone controller such that it can fulfil its function without a further additional device, in particular without a superordinate controller.

A drinking water pipe system according to the invention, which is equipped with the cistern according to the invention, comprises at least one cold water line and/or at least one hot water line, as well as at least one sensor for measuring the water temperature in the cold water or hot water line and/or for detecting a withdrawal of drinking water from the cold water or hot water line, wherein the sensor generates a sensor signal proportional to the measured water temperature and/or to a detected withdrawal of drinking water and wherein the sensor activates a time-measuring device in the case of a detected withdrawal of drinking water.

One advantage of the invention is that by measuring the water temperature in the cold water or hot water line or the water intake line connected thereto by means of the at least one sensor and by means of a temperature-dependent hygienic flush, a flushing amount according to requirements can be achieved during the hygienic flush, so that unnecessarily high water consumption is avoided.

A variant is also advantageous in which the at least one sensor is designed to detect a withdrawal of drinking water from a cold water or hot water line connected to the water intake line or from the water intake line, wherein the sensor activates a time-measuring device in the case of a detected withdrawal of drinking water and the controller generates a control signal for actuating the valve assembly in order to trigger a hygienic flush if a predefined time interval has been exceeded since the last detected withdrawal of drinking water. This also largely avoids unnecessarily high water consumption in order to maintain a flawless drinking water quality.

BRIEF DESCRIPTION OF THE DRAWINGS

The invention is explained in more detail in the following with reference to a drawing representing an exemplary embodiment. In the drawing is shown.

DESCRIPTION OF THE INVENTION

Figure 1A:
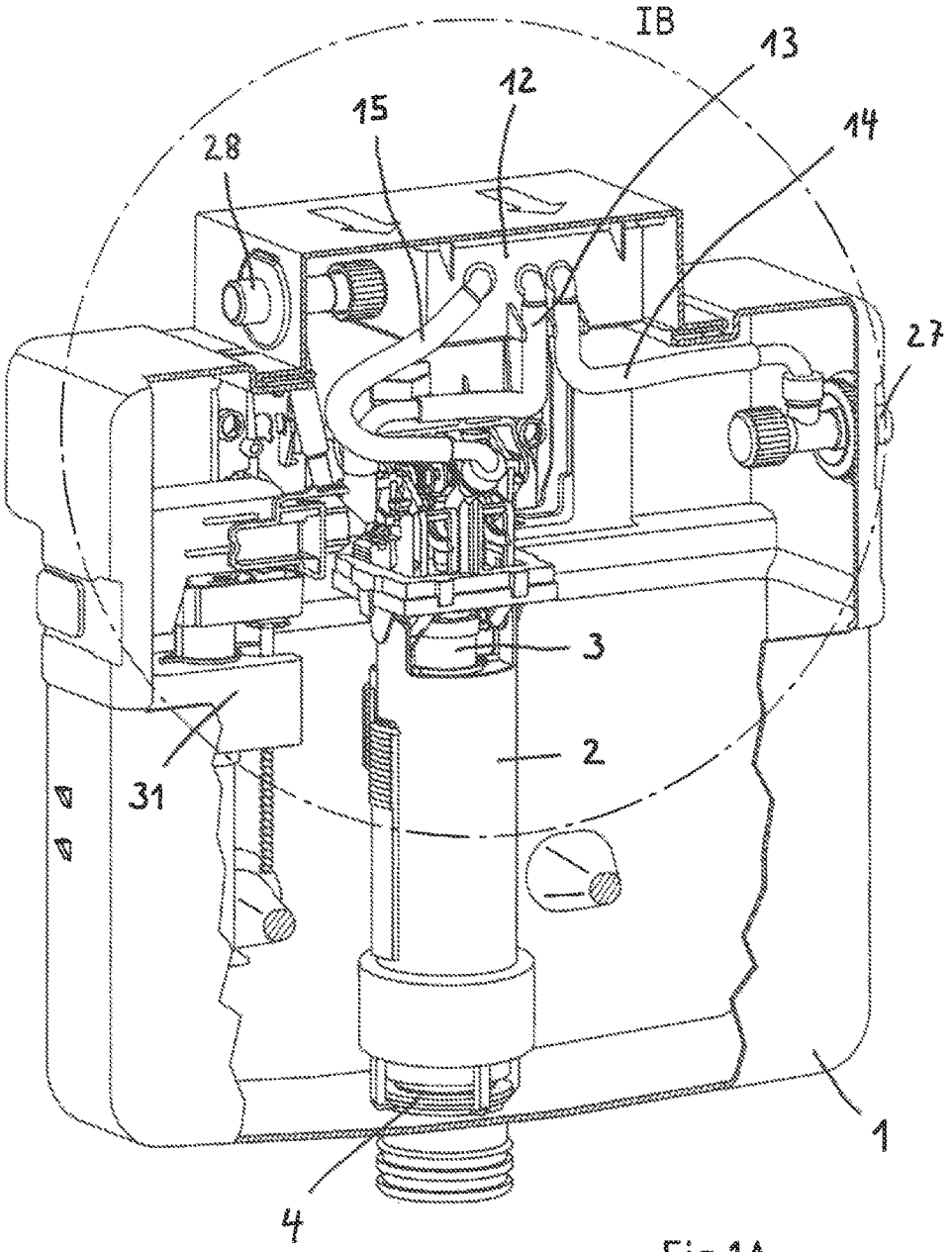
FIG. 1A a cistern according to the invention, which is partially sectioned, in a perspective rear view.
Figure 1B:
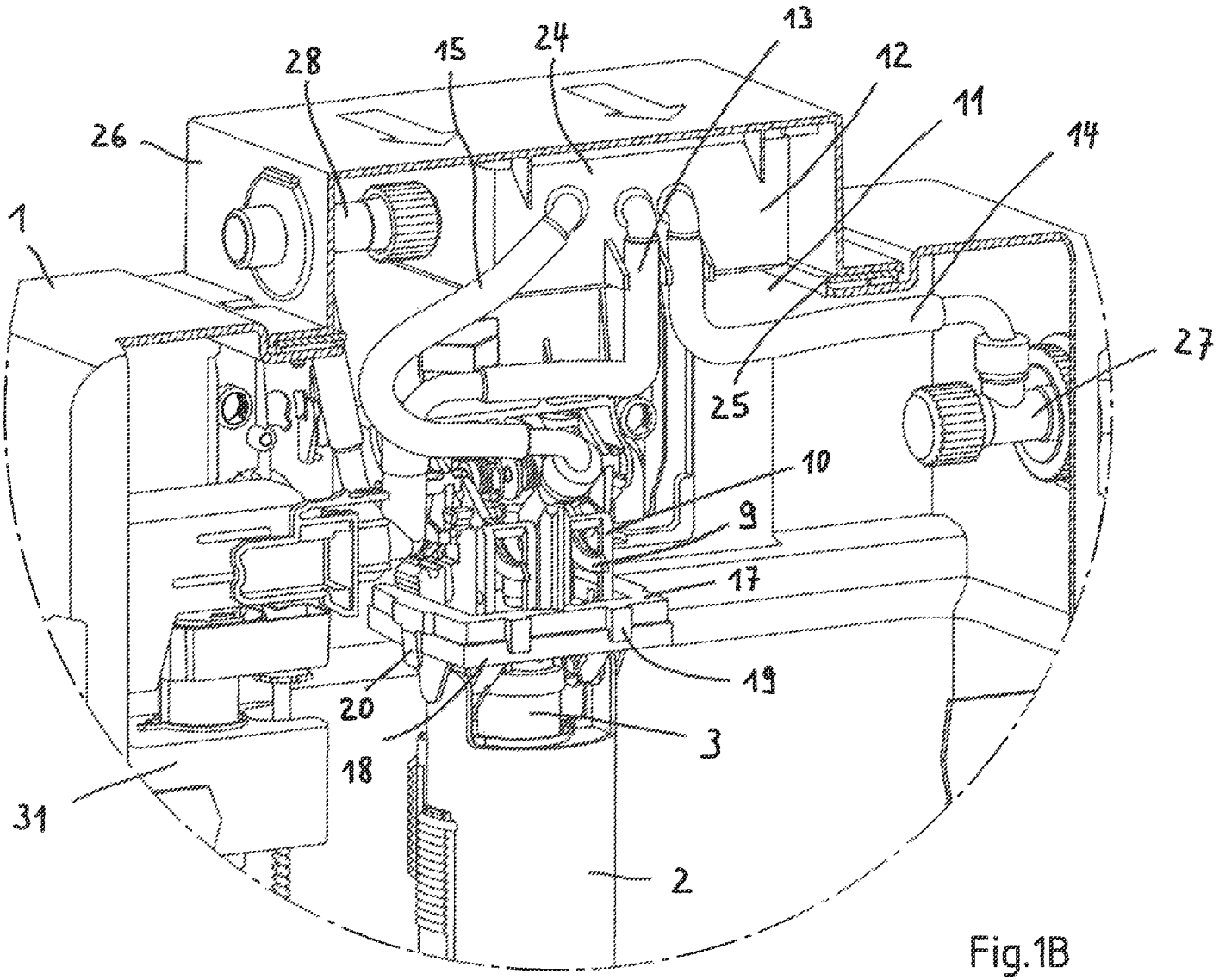
FIG. 1B the section of the cistern delimited in FIG. 1A by a circle IB, shown in enlarged detailed view.

The drawing shows a cistern 1 designed for example as a in-wall cistern for a toilet or urinal. The cistern 1 is equipped with a drain valve 2 which has a closure body 3 which can be lifted from a closed position into a flushing position. The closure body 3 is designed as an overflow pipe and has a seal 4 at its lower end, which rests tightly on a valve seat 5 in the closed position.

The cistern body of the cistern 1 has at its front side 6, and preferably in the upper third of the front side, an inspection opening 7. The inspection opening is elongated and substantially rectangular, with its longitudinal extension running horizontally. A mounting frame (fixing frame) 8 is or will be attached at the inspection opening 7, on which an actuating plate (not shown) is subsequently mounted, which comprises at least one actuating element, e.g. a pivotably mounted button or a pushbutton. The respective actuating element (not shown) is operatively connected to a pivotably mounted lever 9 via a connecting element (not shown), which is for example designed in the form of an actuating pin, wherein the lever is connected to the closure body (overflow pipe) 3 of the drain valve 2 in order to lift the closure body 3 in the event that a flushing is triggered. For this purpose, the overflow pipe 3 is provided with at least one pull tab 10, into which the assigned lever 9 engages.

Furthermore, the cistern body of the cistern 1 also has an inspection opening 11 on its upper side. The cistern 1 thus offers the possibility of actuating the drain valve 2 either from the front or from above depending on the arrangement of the assigned actuating device. For actuation from above, an actuating plate would be arranged on the upper side inspection opening 11. In the exemplary embodiment shown, however, a mixing unit 12, preferably an electronic mixing unit 12, is arranged on the upper side inspection opening 11, which serves the hygienic flushing of a cold water line and a hot water line according to need. It is conceivable to arrange the mixing unit 12 on the front side inspection opening 7 and an actuating plate for actuating the drain valve 2 on the upper side inspection opening 11.

The mixing unit 12 has a valve assembly (not shown in more detail) for mixing, preferably variably mixing drinking water taken in from a cold water intake line 13 and a hot water intake line 14. The hot water intake line 14 can also be designated as a warm water intake line. The mixing unit 12 is provided with a water discharge line 15 for discharging the drinking water let in by the valve assembly. The water discharge line 15 is designed in such manner that it discharges the drinking water let in by the valve assembly directly into the closure body of the drain valve 2 designed as overflow pipe 3.

The water discharge line 15 has an outlet piece 16 which is connected, preferably detachably connected, to the drain valve 2. The outlet piece 16 is provided with a fastening means 17, which is positively connected, preferably detachably locked, to a positioning frame 18 connected to the drain valve 2. The positioning frame 18 is, for example, articulatedly connected to the upper end of the drain valve housing. The fastening means 17 of the outlet piece 16 is substantially U-shaped and has on its outer side stops 19 and locking projections 20, wherein the locking projections 20 engage the positioning frame 18 in the assembled state of the outlet piece 16.

The outlet piece 16 of the water discharge line 15 preferably has a connecting piece 21 for connecting a flexible pipe or hose line. The connecting piece 21 is preferably provided with an external thread for screwing on a union nut 22 connected to the flexible pipe or hose line. The outlet piece 16 preferably has a pipeline-like section 16.1 running obliquely, which begins at the connecting piece 21 and merges into a substantially vertically running section 16.2, the vertical longitudinal axis of which is directed into the overflow pipe 3 of the drain valve 2 and preferably aligns roughly with the longitudinal axis of the overflow pipe 3. The overflow pipe 3 can have a mesh-like basket 23 at its upper end, which prevents the penetration of coarse building material or small parts into the overflow pipe 3. The basket 23 shown in the drawing has a ring on its upper side, so that drinking water let in by the valve assembly is discharged through the ring, without hindrance, directly into the overflow pipe 3. However, the mesh-like basket 23 can also be omitted.

A controller (not shown) integrated in the mixing unit 12 is preferably configured in such manner that it can cause a hygienic flushing of the cold water line according to need independently of the hygienic flushing of the hot water line according to need. The controller is assigned to one or a plurality of sensors (not shown) for measuring the water temperature in the cold water intake line 13 or cold water line and/or in the hot water intake line 14 or hot water line. The respective sensor generates a sensor signal proportional to the measured water temperature. As a function of the sensor signal, the controller integrated in the mixing unit 12 generates a control signal for actuating the valve assembly so that a hygienic flushing is triggered.

Alternatively or additionally, one or a plurality of sensors for detecting a withdrawal of drinking water from the cold water line and/or hot water line can also be assigned to the controller of the mixing unit 12. In this case, the sensor in question generates a sensor signal proportional to a detected withdrawal of drinking water, wherein, in the case of a detected withdrawal of drinking water, the sensor activates a time-measuring device, e.g. a timer. If a predefined, in particular predefinable, time interval has been exceeded since the last withdrawal of drinking water from the cold water line and/or hot water line, the controller then generates a control signal for actuating the valve assembly so that a hygienic flushing is triggered.

Figure 2A:
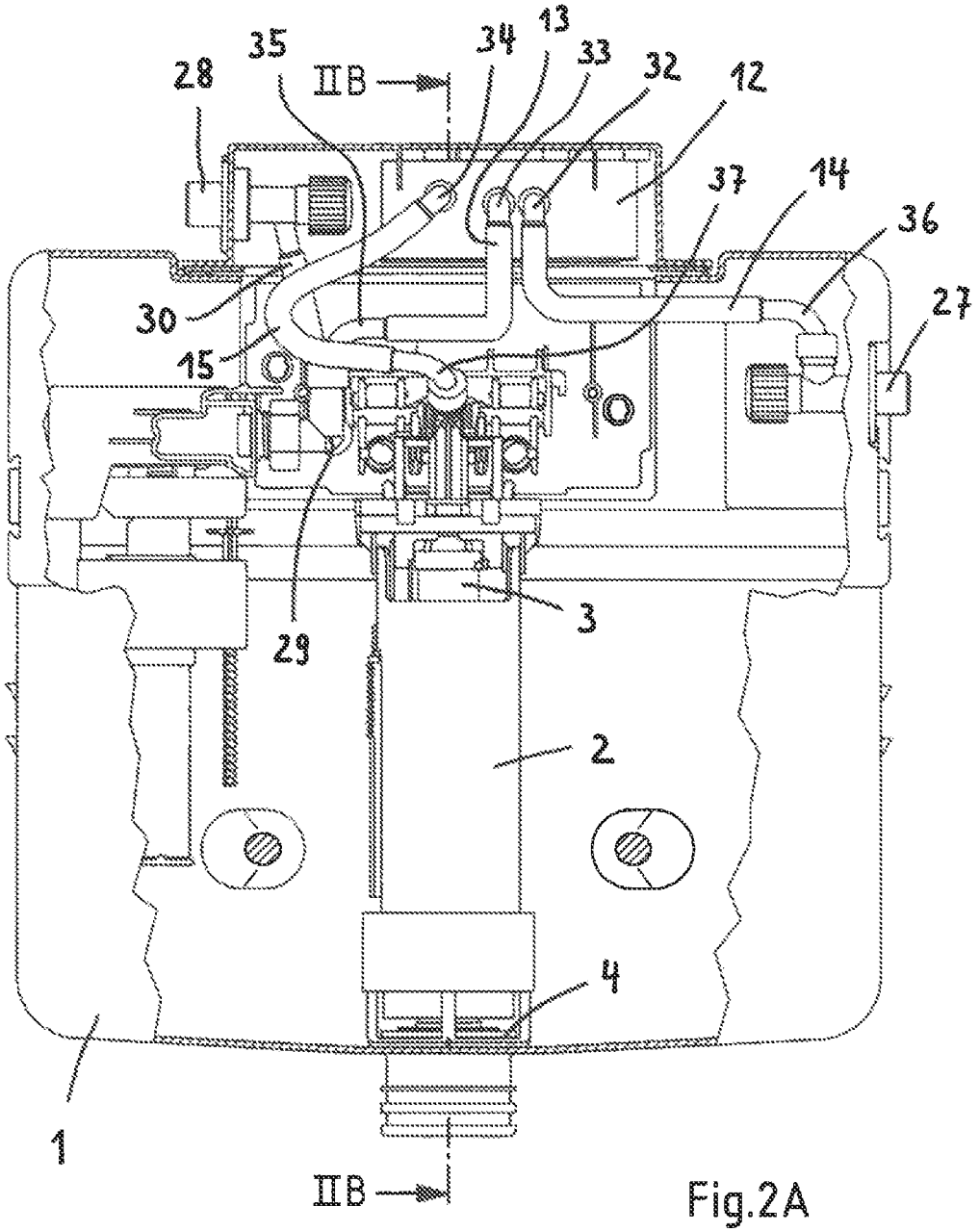
FIG. 2A the cistern from FIG. 1A in rear view.
Figure 2B:
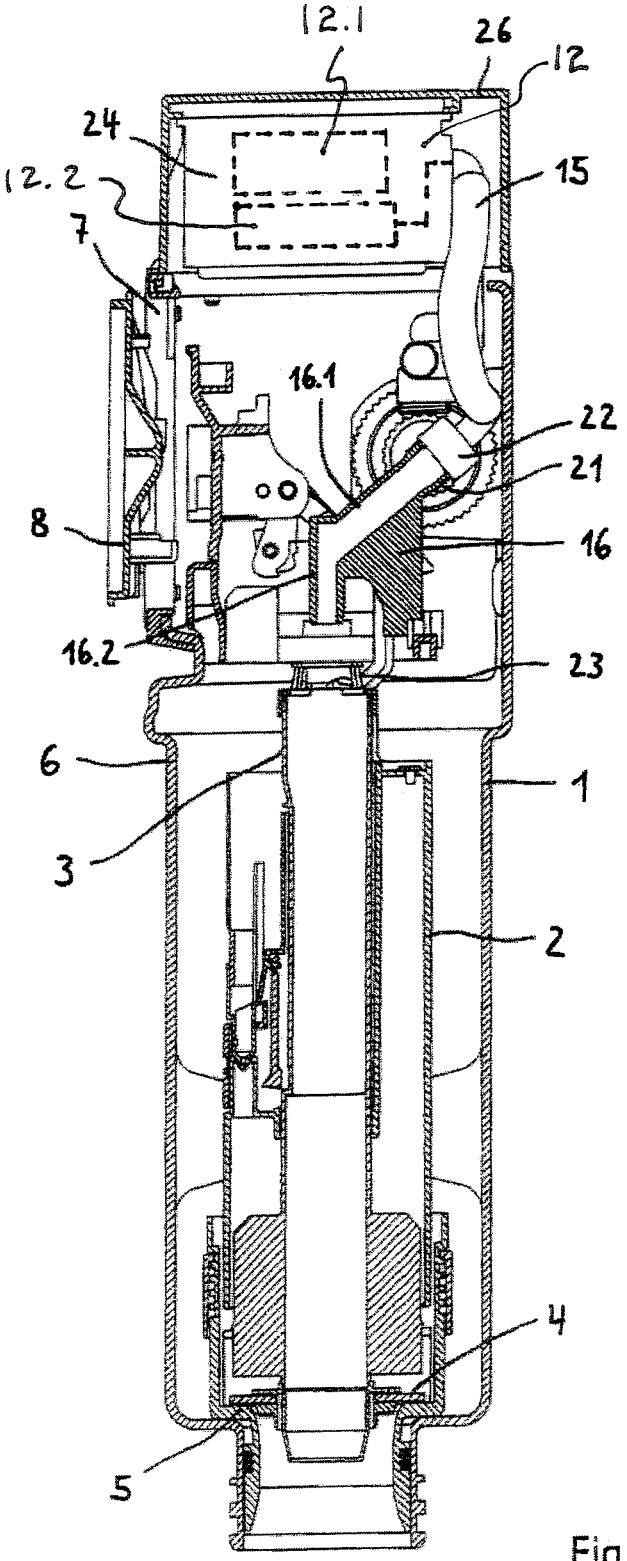
FIG. 2B a vertical sectional view of the cistern along the intersection line IIB-IIB in FIG. 2A.

As illustrated in FIG. 2B, the valve assembly is provided with an electromechanical drive (12.1) coupled to at least one movable, preferably rotatable, valve body (12.2). The electromechanical drive comprises, for example, an electric motor, the motor shaft of which is coupled to the movable valve body of the valve assembly via a toothed gear mechanism. The valve assembly is for example designed in the manner of a mixing cartridge of a single-lever mixer tap.

The output of the valve assembly or the water discharge line 15 is preferably provided with a sensor (not shown) for measuring the water temperature and for generating a temperature signal, wherein the controller integrated in the mixing unit 12 controls the electric motor and thus the valve assembly as a function of the temperature signal.

The valve assembly and the controller are preferably arranged in a common housing 24. The housing 24 or the valve assembly and the controller are mounted on a common support frame 25, which is mounted on the upper side inspection opening 11 of the cistern 1. Furthermore, the support frame 25 is provided with a hood-shaped cover 26, below which the valve assembly and the controller or the mixing unit 12 formed therefrom are/is arranged.

The cistern 1 is provided with connections 27, 28 for connecting a cold water intake line and for connecting a hot water intake line. The connections 27, 28 are preferably designed as angle valves. One (27) of the connections, for example the one for the hot water intake line, is preferably fixed to one of the narrow side walls of the cistern body at the height of the front inspection opening 7. The other connection 28, for example the one for the cold water intake line, is preferably arranged on the upper side of the cistern 1. Preferably, the cover 26 is provided with one of the connections 27, 28. It can be seen in the drawing that the cover 26 is provided with the connection (angle valve) 28 for a cold water intake line, wherein a water line 30 directed into the cistern 1 and having a branch 29 is connected to the connection 28. On the one hand, a float-operated filling valve 31 and, on the other hand, the cold water intake line 13 leading to the valve assembly of the mixing unit 12 are connected to the water line 30 and its branch 29.

The valve assembly of the mixing unit 12 is provided with connecting pieces 32, 33, 34 for the cold water intake line 13, the hot water intake line 14 and the water discharge line 15. The connecting pieces 32, 33, 34 are preferably designed in the form of pipe elbows on which a flexible pipe section of the cold water intake line 13, the hot water inflow line 14 or the water discharge line 15 is pressed or shrink-fitted in a liquid-tight manner. The other end of the flexible pipe section is also provided with a connecting piece 35, 36, 37, which is preferably designed in the form of a pipe elbow piece and has a union nut for connecting the connecting piece (pipe elbow piece) 35, 36, 37 to the assigned branch 29 of the water line 30, to the assigned water intake connection 27 or to the connecting piece 22 of the outlet piece 16 of the water discharge line 15.

The implementation of the invention is not limited to the exemplary embodiment represented in the drawing. In fact, numerous variants are conceivable that also make use of the invention indicated in the attached claims in the case of a design deviating from the exemplary embodiment shown.

The invention claimed is:

1. A cistern for a toilet or urinal, with a drain valve which has a closure body which can be lifted from a closed position into a flushing position, wherein the closure body is an overflow pipe and has a seal which, in the closed position, rests sealingly on a valve seat, with at least one water intake line, with a valve assembly for letting in drinking water present in the water intake line, with a water discharge line for discharging the drinking water let in by the valve assembly, wherein the valve assembly lets in the drinking water into the water discharge line, and with a controller and a sensor assigned to the controller, wherein the controller generates a control signal for actuating the valve assembly as a function of a sensor signal, the sensor signal being proportional to a measured water temperature in the water intake line, and/or when a predefined time interval has been exceeded since a last withdrawal of drinking water from the water intake line, wherein, as a function of the control signal, the valve assembly allows water from the water intake line which is upstream of the valve assembly to travel through the valve assembly to the water discharge line which is downstream of the valve assembly, wherein the water discharge line is in such manner that it discharges the drinking water let in by the valve assembly directly into the overflow pipe.

2. The cistern according to claim 1, wherein the at least one water intake line is two or more lines, wherein one of the water intake lines is provided as a cold water intake line and another of the water intake lines is provided as a hot water intake line.

3. The cistern according to claim 2, wherein the valve assembly is a mixing unit for variably mixing drinking water let in from the cold water intake line and from the hot water intake line.

4. The cistern according to claim 3, wherein an outlet of the valve assembly or the water discharge line is provided with the sensor assigned to the controller, the sensor measuring the water temperature and for generating a temperature signal, the temperature signal being the control signal, and the controller controlling the valve assembly based upon the control signal.

5. The cistern according to claim 1, wherein the valve assembly is provided with an electromechanical drive, which is coupled to at least one movable valve body.

6. The cistern according to claim 1, wherein the water discharge line has an outlet piece, which is connected to the drain valve.

7. The cistern according to claim 6, wherein the outlet piece is provided with a fastening means, which is positively connected to a positioning frame connected to the drain valve.

8. The cistern according to claim 1, wherein the valve assembly and the controller are arranged in a common housing.

9. The cistern according to claim 8, wherein the valve assembly and the controller are mounted on a common support frame.

10. The cistern according to claim 9, wherein the support frame is mounted on an inspection opening of the cistern.

11. The cistern according to claim 1, wherein the valve assembly and the controller are arranged below or behind a cover.

12. The cistern according to claim 11, wherein the cover is provided with a connection for the at least one water intake line wherein a water line directed into the cistern and having a branch is connected to the connection.

13. The cistern according to claim 1, wherein the controller is provided with a network connection for linking to a further or superordinate controller.

14. The cistern according to claim 1, wherein the cistern is an in-wall cistern.

15. A drinking water pipe system, a cistern according to claim 1, with at least one cold water line connected to the at least one water intake line and/or at least one hot water line connected to the at least one water intake line, with a further sensor for detecting a withdrawal of drinking water from the cold water or hot water line, wherein the sensor generates a sensor signal proportional to the measured water temperature, and wherein, when the further sensor is configured to detect a withdrawal of drinking water from the cold water or hot water line the drinking water pipe system comprises a time-measuring device and the further sensor activates the time-measuring device when the withdrawal of drinking water is detected, and wherein the controller generates the control signal for actuating the valve assembly as a function of the sensor signal of the further sensor and/or when the predefined time interval has been exceeded since the last withdrawal of drinking water detected by the further sensor, and wherein, as a function of the control signal the valve assembly allows water from the water intake line which is upstream of the valve assembly to travel through the valve assembly to the water discharge line which is downstream of the valve assembly.

* * * * *